United States Patent [19]

Babcock

[11] Patent Number: 4,544,153

[45] Date of Patent: Oct. 1, 1985

[54] SLALOM WATERSKIING SIMULATOR

[76] Inventor: Michael A. Babcock, Star Rte. 1, Box 428, Danbury, Wis. 54830

[21] Appl. No.: 668,561

[22] Filed: Nov. 5, 1984

[51] Int. Cl.[4] ..... A63B 69/18

[52] U.S. Cl. ..... 272/97; 272/130

[58] Field of Search ..... 272/97, 130; 434/253

[56] References Cited

U.S. PATENT DOCUMENTS

| | | | |
|---|---|---|---|
| 2,573,808 | 11/1951 | Ravoire | 434/253 X |
| 3,159,400 | 12/1964 | Brass et al. | 272/97 X |
| 3,408,067 | 10/1968 | Armstrong | 272/97 X |
| 3,455,550 | 7/1969 | Hall | 272/97 |
| 3,467,374 | 9/1969 | Auer | 272/97 |
| 3,531,110 | 9/1970 | Marchu | 272/97 |
| 3,912,260 | 10/1975 | Rice | 272/97 |
| 3,941,377 | 3/1976 | Lie . | |
| 4,340,214 | 7/1982 | Schutzer | 272/130 X |
| 4,396,189 | 8/1983 | Jenkins | 272/97 |

FOREIGN PATENT DOCUMENTS

| | | |
|---|---|---|
| 832295 | 6/1938 | France . |
| 481658 | 1/1970 | Switzerland . |

*Primary Examiner*—Harland S. Skogquist

*Attorney, Agent, or Firm*—Vidas & Arrett

[57] ABSTRACT

A slalom waterskiing simulator for exercising muscles used in aggressive slalom waterskiing, the apparatus including a pivoting swing arm and associated mechanism for controllably moving and manuevering a practicing skiier between the two extreme positions normally encountered in slalom-type waterskiing.

12 Claims, 7 Drawing Figures

SLALOM WATERSKIING SIMULATOR

BACKGROUND OF THE INVENTION

This invention relates to apparatus for exercising and practicing slalom-style waterskiing. More particularly, it is directed to a novel apparatus for use indoors as an exercise device while also giving the experience of slalom-type waterskiing.

The apparatus of the invention has been designed to simulate the balance and muscular exertion normally experienced in slalom-style waterskiing. The apparatus enables a practicing skier to reach or maintain the muscular condition required for agressive waterskiing. For the skier who is unable to ski as often as necessary to advance or maintain a high level of skill and endurance, the apparatus of this invention has particular applicability.

Working out on the apparatus is much simpler than actually engaging in waterskiing as such. There is no need for a boat operator and a spotter, nor is the time and expense of obtaining and operating a ski boat required. Neither does the weather affect scheduled practice sessions since the apparatus may be set up indoors and used year round.

SUMMARY OF THE INVENTION

The slalom-style waterskiing simulator apparatus is disclosed in detail hereinbelow. The apparatus is based primarily on a swinging-arm concept which carries a practicing skier between the extreme positions normally encountered in slalom-style skiing by rotating a ski mount carrying the practicing skier at one end of the swinging arm. The other end of the swinging arm is controlled by an energy storing and dispensing mechanism such as a fluid cylinder which functions to dampen the rotation of the arm during its initial movement in one cycle, thus storing energy which is released in the form of an accelerating force applied against the arm and the latter portion of its swinging movement in completing the cycle. Repeated cycles simulate the manuevers encountered during slalom-style waterskiing. The apparatus is operated solely by force exerted by the practicing skier.

DESCRIPTION OF THE PREFERRED EMBODIMENT

Figure 1:
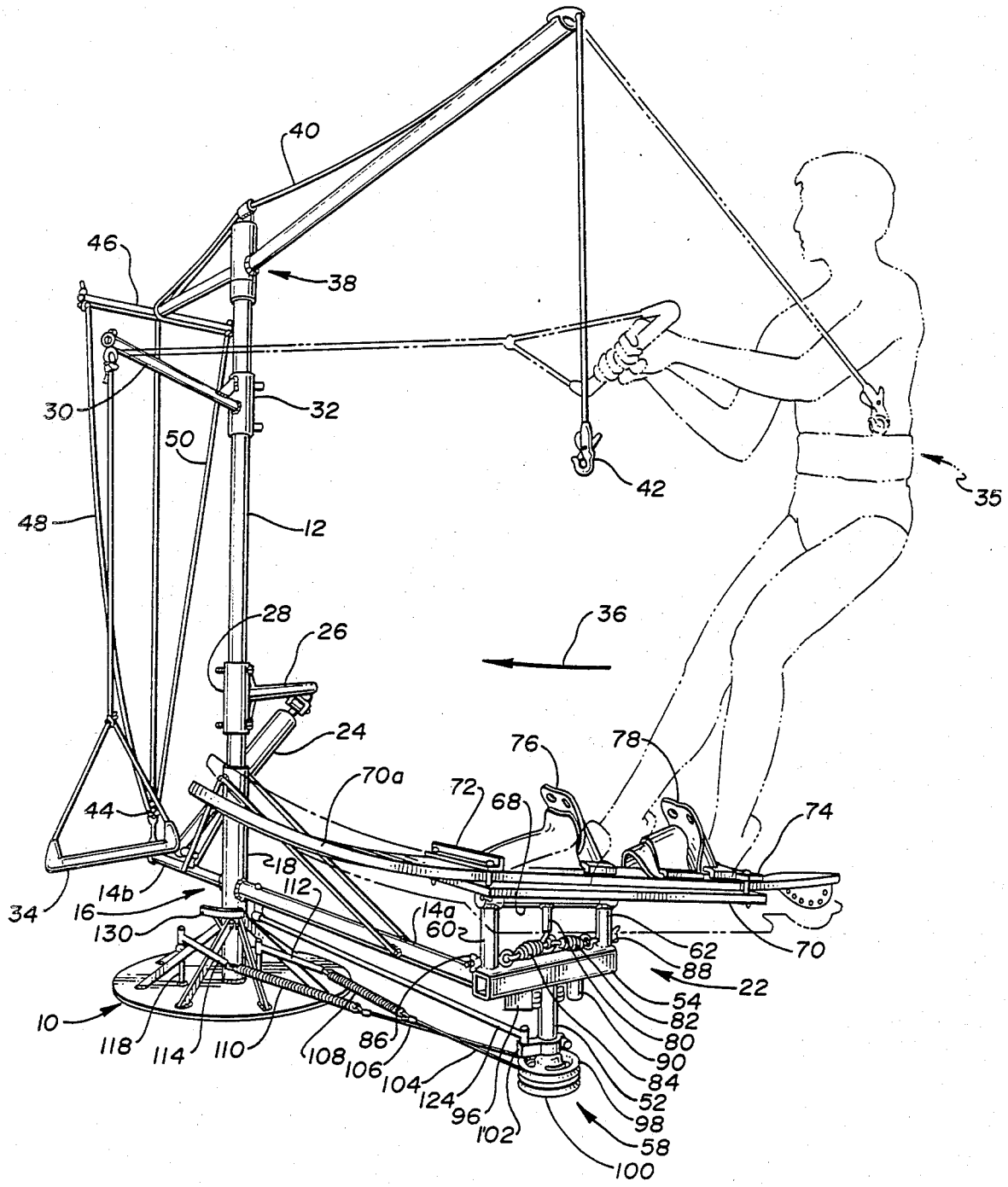
FIG. 1 is a perspective view of the apparatus of the invention at rest and further including in phantom line a human figure or practicing skier on the ski mount of the apparatus with certain related portions of the apparatus also shown in phantom line to illustrate the functional use of the apparatus.

The apparatus of the invention comprises a stationary base portion 10 which carries a fixed upright support such as upstanding pole 12. Pole 12 supports a swing arm 14 which is mounted on pole 12 at a pivot point generally indicated at 16 intermediate the opposing end portions 14*a* and 14*b* of swing arm 14 such that the swing arm may rotate in a horizontal plane between two extreme positions. Preferably, swing arm 14 is rotatably mounted on pole 12 by means of a sleeve 18 which can be slid over pole 12 to rest against a support flange 20 (best seen in FIG. 2) which supports swing arm 14 at a predetermined heighth above base 10.

Swing arm 14 carries at one end portion 14*a* thereof a pivotal ski mount generally indicated at 22, the mechanical arrangement and function of which will be described in more detail hereinbelow.

End portion 14*b* of swing arm 14 is connected to an energy-storing and release mechanism such as an automobile air shock absorber 24 or other fluid actuated cylinder or spring-type device which is connected at its other end to a fixed arm 26 which extends outwardly from upright pole 12 in a direction which is preferably intermediate the extreme positions of swing arm 14 and at a level on pole 12 which is higher than swing arm 14. The amount of resistance which the operating skier must overcome is adjusted by the amount of air pressure added to the shock absorber. For illustration, a Rockhill TM #49155 air shock absorber distributed by Bumper to Bumper Program may be used. Other orientations and locations of cylinder 24 and the fixed point of attachment provided by arm 26 may be utilized. Preferably, fixed arm 26 is attached to upright pole 12 by means of a sleeve 28 and suitable bolts as will be obvious to those of ordinary skill in the mechanical arts.

At a higher point on pole 12 another fixed arm 30 is positioned by means of a similar sleeve and bolt arrangement 32 so as to position arm 30 180° from arm 26. Attached to arm 30 is a ski tow and handle means 34 by which a practice skier shown in phantom in FIG. 1 may exert force on swing arm 14 to cause its rotation from one extreme position to another in the direction indicated by arrow 36.

The top or upper end of pole 12 pivotally carries safety support boom assembly generally indicated at 38. The assembly includes a safety line 40 and safety hook 42 which may be attached to a practicing skier as shown in phantom in FIG. 1 to provide support should the practicing skier lose balance. Line 40 is secured at a remote end 44 in any suitable manner. Assembly 38 also includes a cross piece 46 and cables 48 and 50 which are attached to cross piece 46 and to end portion 14*b* of swing arm 14 thereby causing boom assembly 38 to track with the movement of the practicing skier and swing arm 14. With the use of a harness or the like, a practicing skier can clip to the apparatus by means of safety hook 42 and avoid striking the floor or portions of the apparatus if balance is lost.

Figure 3:
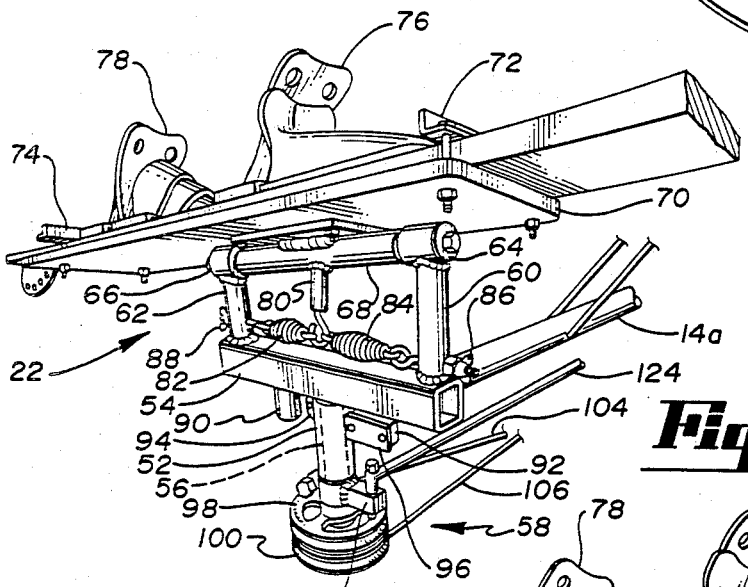
FIG. 3 is a partial perspective view of the ski mount portion of the apparatus in one extreme position.
Figure 4:
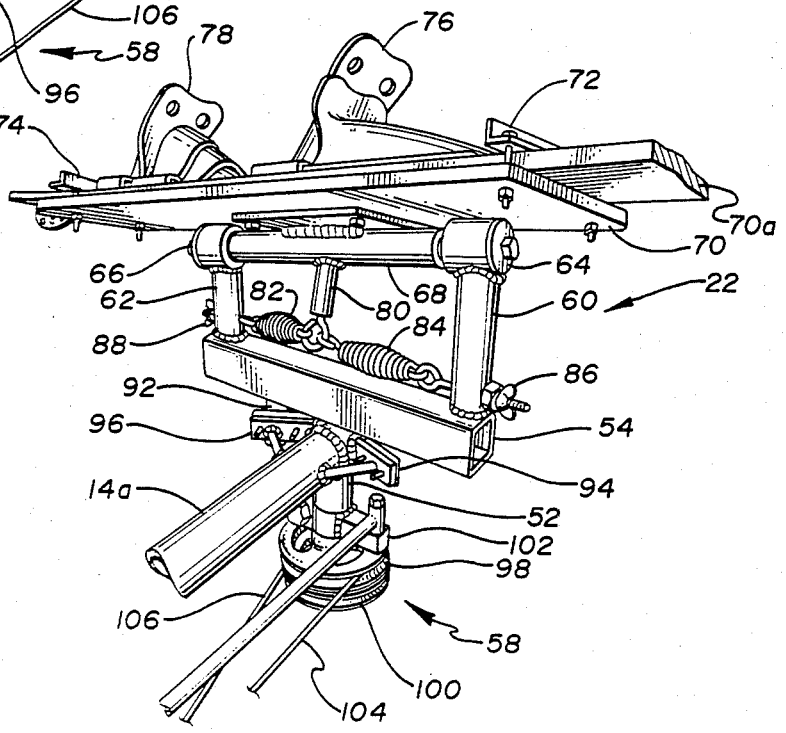
FIG. 4 is a partial perspective view showing the mount of FIG. 3 in the second extreme position in which the mount is rotated 180.

Referring now to the pivotal ski mount 22, it will be described in more detail with reference to FIGS. 2, 3 and 4 in addition to FIG. 1.

As has already been pointed out, pivotal mount 22 is supported at the end of swing arm 14*a* in a rotational manner to allow the practicing skier to rotate through approximately 180° from the one extreme position shown in FIG. 1 to a second extreme position in which the skier is pointing in a reverse direction. This is preferably accomplished by the structure shown in the figures which includes an upright sleeve 52 which is welded to the end of arm 14 as shown (best seen in FIGS. 1, 3 and 4). Pivoting means 22 includes a horizontal support member 54 having a depending central arm 56 (seen in FIG. 3) which is rotatably received in sleeve 52 with a depending portion (not shown) extending below sleeve 52 for the attachment of an additonal mechanism generally indicated at 58 which will be described in detail further hereinbelow. Extending upwardly from horizontal support 54 are a pair of spaced upright arms 60 and 62, 60 being of greater length than 62 to provide an inclined support arrangement including sockets 64 and 66 (seen in FIGS. 3 and 4) which pivotally receive inclined arm 68 therebetween. Attached to the top of inclined arm 68 by any suitable mounting arrangement is a skier support means which may include a clamping arrangement comprised of mount board 70, clamps 72 and 74 which by means of several bolts may be utilized to hold an actual slalom ski in a mountable position for receiving a practicing skier as shown in the Figures. Although it is not necessary that an actual ski be utilized, it is preferred. However, the slalom ski mounts for the practicing skier's feet shown at 76 and 78 may also be used separately and even connected directly to mounting board 70 to simulate an actual ski if desired. As shown, the pivotal mounting of inclined arm 68 allows for a rocking motion of the mounting assembly including the ski and a practicing skier mounted thereon to simulate the rocking motion experienced under actual skiing conditions. This motion is dampened and controlled by means of depending arm 80 which is connected to a pair of springs 82 and 84 which are in turn respectively connected to uprights 60 and 62 and suitably tensioned by means of anchoring bolts 86 and 88 to dampen the rocking motion as desired. Illustratively, springs 82 and 84 may be made of 0.164 music wire having a tapered wind from ½ inch to 1 inch in I.D. (ends to center) and with 12 coils, 3½ inches long.

A pair of spaced stop members 90 and 92 depend from the underside of horizontal support member 54 in spaced positions to allow their respective abutment against stops 94 and 96 which are carried by sleeve 52. The purpose of these stops is to limit the rotational movement of pivotal ski mount 22 to approximately 180°.

Referring now to the mechanism generally indicated at 58, it is the purpose of this arrangement to control the rotation or pivotal movement of pivotal mount 22 and to provide an automatic turning mechanism therefor. Mechanism 58 includes a pair of pulleys 98 and 100 which are fixed to the depending end portion of shaft 56. Also fixed to shaft 56 and immediately above the pair of pulleys is a relatively short control arm 102. Lengths of cable 104 and 106 are respectively attached to pulleys 98 and 100 and to a pair of elongate springs 108 and 110 which are in turn connected in any suitable manner to a pair of arms 112 and 114. For illustration, springs 108 and 110 may typically be made of 0.127 zinc-plated music wire having an I.D. of ⅝ inches and 76 coils. Arms 112 and 114 are rotatably connected to base 10 by means of upright pins 116 and 118 and may be spring biased as best seen in FIG. 2 by springs 120 and 122.

Figure 2:
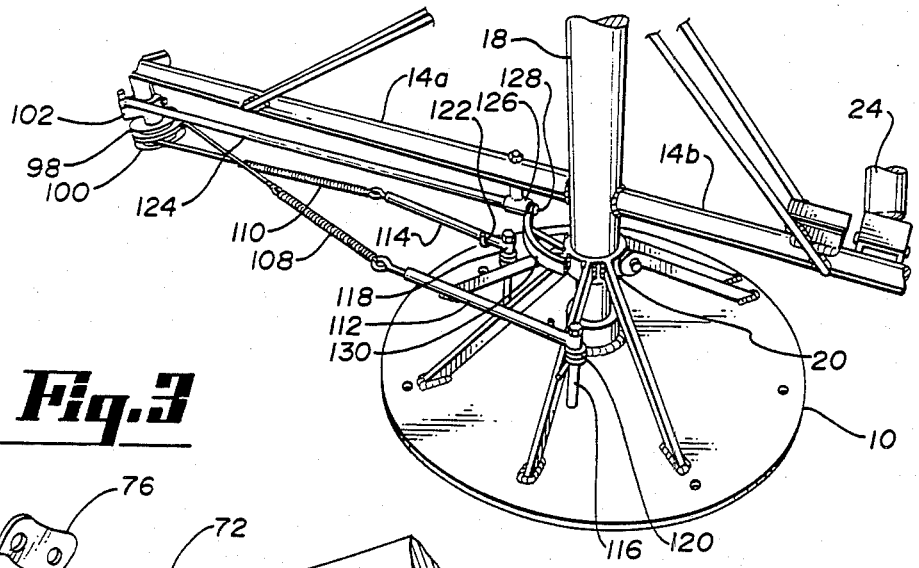
FIG. 2 is a partial perspective view of the apparatus of FIG. 1.

Mechanism 58 also includes a latching arm 124 which is pivotally connected to control arm 102 and extends under swing arm 14 to be slidably supported in a support sleeve 126 (best seen i FIG. 2) which is supported under the swing arm **14*a* so as to place the inner end 128 of latch arm 124 in abutment with arcuate camming surface 128 which is carried by support 10 preferably by attachment to flange 20 as best seen in FIGS. 1 and 2. Camming surface 128 is oriented toward the pivotal ski mount 22 and arcuately extends in length between the extreme positions of the swing arm to provide an abutment or camming surface for end 128 of latch arm 124 during movement of the swing arm between the two extreme positions. However, it is important to note that the length of arcuate surface 130 is established so as to disengage with end 128 of latch arm 124 when the swing arm has reached either of the two extreme positions so as to allow the requisite 180° pivoting movement of pivotal mount 122** and hence the mounted skier as well.

Figure 5:
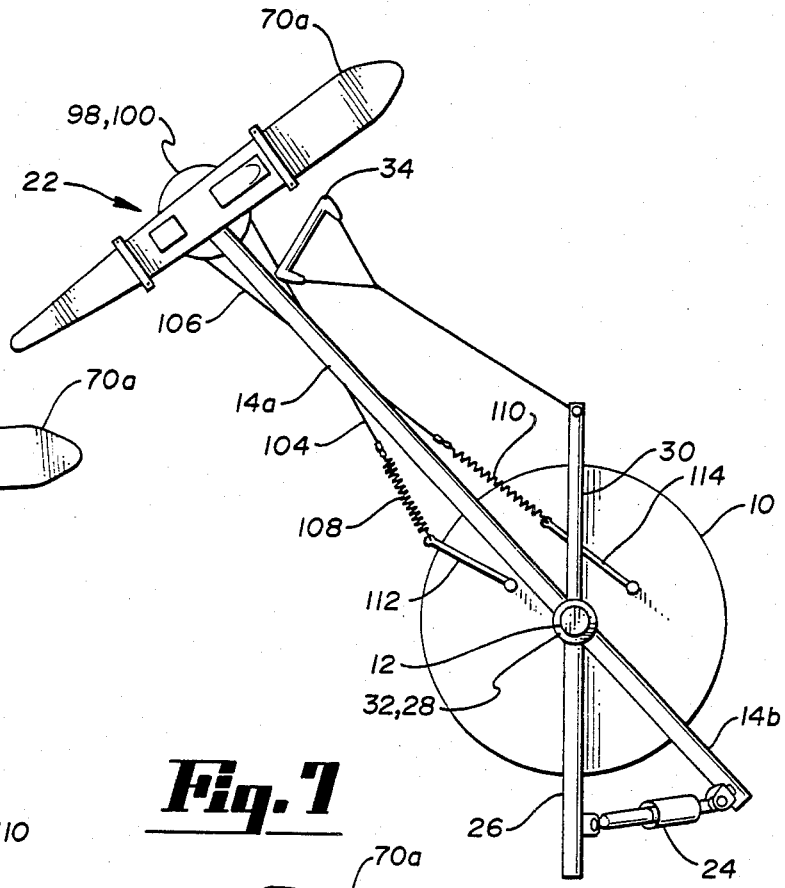
FIGS. 5, 6 and 7 are diagrammatic illustrations showing the movement of the apparatus from one extreme position to the other in one swing cycle.
Figure 6:
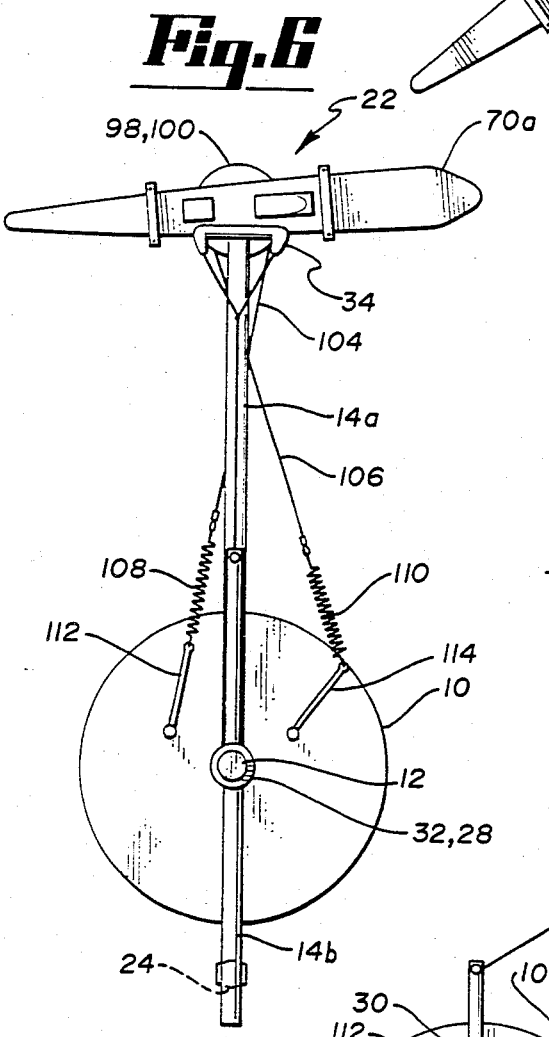
Figure 7:
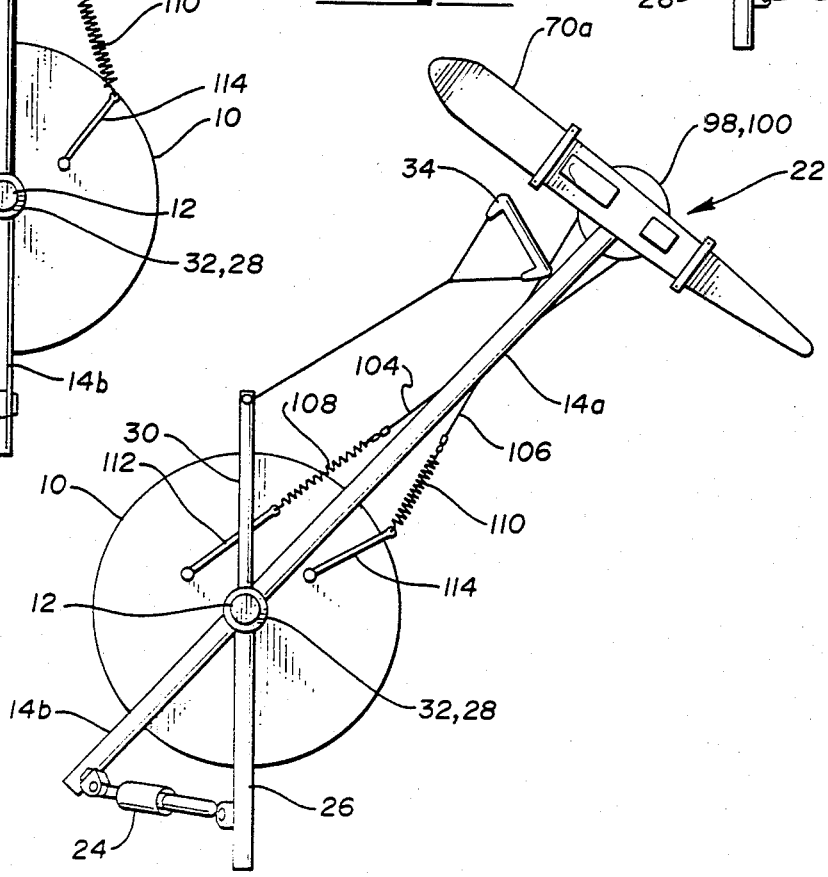

Referring now to FIGS. 5, 6 and 7, the operation of the apparatus of the invention will be described.

FIGS. 5 and 7 show the apparatus at rest in either of the two extreme positions of swing arm 14 in which the ski **70*a* is in two extreme positions on the pivotal mount generally indicated at 22, the ski positions being approximately 180° different with respect to each other. In FIG. 5, the air shock or other hydraulic or pneumatic cylinder is extended and pushing end 14*b* of swing arm 14 away from fixed arm 26 to hold swing arm 14 in the position shown in FIG. 5. Since the ski is fully rotated against abutments 94 and 96, it cannot rotate in a counterclockwise direction (FIG. 5) but with swing arm 14 in the extreme position shown, latch arm 124–128 is not in abutment with arcuate camming surface 130 hence ski 70*a* and pivotal mount 22 can rotate in a clockwise direction. Extended spring 110** is resisting such rotation at this particular position of the apparatus.

Reffering now to FIG. 6, as the ski is pulled a few inches forward, latch arm 124 is brought into abutment with arcuate camming surface 130 thereby preventing clockwise rotation of ski **70*a*. This movement is provided by the practicing skiers pulling on tow handle 34 and applying pressure against the ski 70*a* with his legs. As further effort is extended by the practicing skier to move the ski forward, extended spring 108 collapses and opposing spring 110 begins to exert a pulling force. In this phase of the operating cycle, air shock 34 is compressed but is pushing in a straight, vertical direction as swing arm 14*a* has rotated to a position where end portion 14*b* is directly aligned with fixed arm 26. No work is required to hold ski 78 in this center position between the two extreme positions of the swing arms rotation. When using the machine, the momentum of the practicing skier's weight and that of swing arm 14 continues the forward motion and, as the center position shown in FIG. 6 is crossed, air shock 24 begins to tilt and provide a sideward pushing effort against end portion 14*b* of swing arm 14. The practicing skier continues to pull on tow handle 34 to slow down the travel imparted by this action of cylinder 24**.

Referring now to FIG. 7, as the swing arm 14 continues its rotation past the center position of FIG. 6 to the position shown in FIG. 7 but is still a few inches from the end of its travel, latch arm 124 slides off of arcuate camming surface 130 to release pivotal mount 22 for rotation. Spring 108 is fully extended at this point and now exerts a force causing ski **70*a* to spin aboutface to the position shown in FIG. 7. The end of the spin is stopped by the spaced stops 90 and 92 and the corresponding abutment surfaces 94 and 96**. The cycle is then repeated but in the reverse direction for any desired practice time.

It can be seen that the apparatus of the invention provides a simple self-energized slalom skiing simulator which can be readily fabricated from standard structural materials such as stock metal, pipe and the like. As already indicated, cylinder 24 is preferably of the auto air shock-type which is readily available also.

The preferred embodiment of the apparatus of the invention has been illustrated and described hereinabove. However, it is to be understood that the invention is susceptible of many modifications which will fall within the spirit and scope of the appended claims.

What is claimed is:

1. Apparatus for practicing slalom waterskiing, comprising:

support means;

an elongated swing-arm mounted on the support means at a pivot point intermediate opposing ends of the arm for limited back and forth rotation between two extreme positions in a horizontal plane in response to effort by a practice skier;

pneumatic cylinder means extending between one end portion of the swing-arm and a fixed point spaced from the arm for dampening motion of the swing-arm in its initial movement during a swing toward one extreme position and for providing a pushing force in its later movement during such a swing, the ends of the cylinder being connected respectively to the arm and the fixed point by means of pivotal joints to accommodate the swinging movement of the cylinder in response to movement of the swing arm;

a pivotal ski mount carried at the other end portion of the swing-arm and adapted to pivot thereon between two extreme positions in a horizontal plane;

rotating means operably attached to the pivotal ski mount for rotating it from one extreme position to the other when the swing-arm moves from one of its extreme positions to the other, and ski tow handle means connected to the apparatus above the swing-arm at a location intermediate the two extreme positions of the swing arm whereby a practice skier on the ski mount may apply effort to the ski arm to impart motion thereto thereby simulating slalom waterskiing.

2. The apparatus of claim 1 wherein the support means includes a stationary base and an upwardly extending support.

3. The apparatus of claim 1 wherein the pneumatic cylinder is a double-acting air cylinder.

4. The apparatus of claim 1 wherein the cylinder in connected between the swing-arm and a fixed arm extending from the support means at a level different than that of the swing arm.

5. The apparatus of claim 4 wherein the fixed arm is higher than the swing-arm.

6. The apparatus of claim 1 wherein the pivotal ski mount includes rocking means for providing a lateral rocking motion of the practice skier on the mount.

7. The apparatus of claim 1 wherein stop means is included with the rotating means and associated with the pivotal mount such that the pivotal movement of the mount is limited to the two extreme positions and pivoting therebetween.

8. The apparatus of claim 1 wherein the tow handle means includes a length of tow rope.

9. The apparatus of claim 1 wherein latch means is included and operatively associated with the swing arm and pivotal mount for preventing pivotal movement of the mount during swinging movement of the swing-arm between the two extreme positions.

10. The apparatus of claim 1 wherein the pivotal ski mount comprises:

a substantially horizontal support member pivotally carried by the swing arm;

a pair of spaced upright members carried by the support member one of which extends higher than the other;

an inclined mounting member extending between the upright members and laterally pivotal therewith, the mounting member being adapted to receive a ski mount or the like;

a depending arm extending downwardly from the mounting member, and a pair of spring members respectively extending from lower portions of the upright members and connected to the depending arm to dampen the lateral pivoting of the mounting member.

11. The apparatus of claim 10 wherein the other end portion of the swing arm which receives the pivotal ski mount includes an upright sleeve, and the horizontal support member includes a depending arm adapted for insertion into the sleeve and rotation therein, the arm extending through the sleeve with a portion thereof depending below the sleeve, and there is also included:

a pair of pulleys attached to the depending portion of the arm normally with respect to its longitudinal axis for rotating the arm and mount;

a relatively short control arm attached to the depending portion of the arm and extending therefrom substantially parallel to the horizontal support member and in the direction of the higher of the upright members for rotation with the arm;

a pair of spaced rotatable arms extending from the apparatus support under the swing arm toward the ski mount, a pair of elongatable springs, each of which is attached to one of the rotatable arms, respectively and a pair of cable lengths attached to the springs, the cable lengths crossing each other and respectively attached to one of the pulleys at the depending arm whereby movement of the swing-arm from one extreme position to the other stretches one of the springs, bringing to bear on one of the pulleys to which the spring is connected by the aforesaid cable length a rotational force, the direction of which is dependent on the direction of movement of the swing-arm and which tends to rotate the mount from one of its extreme positions in an inward direction toward the apparatus support than in an outward direction away from the apparatus support through substantially 180°;

a sleeve carried under the swing-arm in proximity to the arcuate camming surface; and a latch arm extending between the control arm at the ski mount and the camming surface, the end at the mount being pivotally connected to the control arm and the other end portion being slidably received by the sleeve with the end extending therethrough to abut the camming surface when the swing-arm is interemediate the two extreme positions whereby rotation of the mount is prevented unless the swing arm is in one of the extreme positions and the end of the latch arm is out of engagement with the camming surface.

12. The apparatus of claim 1 including a safety rope support arrangement for connection to a practice skier when on the ski mount.

* * * * *